US007316174B2

(12) United States Patent
Sekiya

(10) Patent No.: US 7,316,174 B2
(45) Date of Patent: Jan. 8, 2008

(54) CUTTING MACHINE FOR PLATE-SHAPED MATERIAL

(75) Inventor: Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 546 days.

(21) Appl. No.: 11/012,110

(22) Filed: Dec. 16, 2004

(65) Prior Publication Data

US 2005/0136801 A1 Jun. 23, 2005

(30) Foreign Application Priority Data

Dec. 18, 2003 (JP) ..... 2003-420858

(51) Int. Cl.

| | |
|---|---|
| ***B26D 1/143*** | (2006.01) |
| ***B26D 5/02*** | (2006.01) |
| ***B26D 7/06*** | (2006.01) |
| ***H01L 21/78*** | (2006.01) |
| ***H01L 21/304*** | (2006.01) |

(52) U.S. Cl. ..... 83/861; 83/875; 83/404; 125/13.01; 125/35; 438/462; 451/213

(58) Field of Classification Search ..... 83/35, 83/272, 404, 412, 414, 425, 435.12, 861, 83/865, 875, 876, 882, 906; 125/12, 13.01, 125/15, 35; 438/460, 462, 463; 451/10, 451/11, 14, 178, 200, 213

See application file for complete search history.

(56) References Cited

U.S. PATENT DOCUMENTS 5,839,337 A * 11/1998 Neu ..... 83/255
6,102,023 A * 8/2000 Ishiwata et al. ..... 125/13.01
2002/0184982 A1* 12/2002 Smith et al. ..... 83/39
2006/0112802 A1* 6/2006 Fujinami ..... 83/310

FOREIGN PATENT DOCUMENTS

| | | | |
|---|---|---|---|
| JP | 2001-077057 | | 3/2001 |
| JP | 2005-183584 | * | 7/2005 |
| JP | 2007-81317 | * | 3/2007 |

* cited by examiner

*Primary Examiner*—Clark F. Dexter
(74) *Attorney, Agent, or Firm*—Wenderoth, Lind & Ponack, L.L.P.

(57) ABSTRACT

When a plate-shaped material, such as a CSP substrate, that does not require exact precision is divided, a cutting machine is provided with not only first and second chuck tables, but also first and second cutting units. Then, each plate-shaped material, which is placed on a respective chuck table, is aligned immediately before it is cut, so that the Y-axis index control and the X-axis cutting movement control are established for cutting by the cutting units. A cutting portion is cut in the first direction by the first cutting unit according to the Y-axis index control and the X-axis cutting movement control, and subsequently a cutting portion is cut in the second direction by the second cutting unit. Hence, the cutting portions of the plate-shaped materials placed on the first and second chuck tables are cut by the first and second cutting units by sharing a role.

4 Claims, 2 Drawing Sheets

CUTTING MACHINE FOR PLATE-SHAPED MATERIAL

BACKGROUND OF THE INVENTION

1. Field of the Invention

The present invention relates to a cutting machine to divide a CSP substrate of a rectangular shape provided with plural semiconductor chips, such as ICs and LSIs, formed thereon in a matrix fashion and covered with resin into individual semiconductor chips.

2. Related Art

A CSP substrate of this type, on which plural semiconductor chips, such as ICs and LSIs, are formed, is divided into individual semiconductor chips, for example, by a dividing machine known as a dicing machine. Each semiconductor chip is then packaged with resin in a chip size to be used widely by being incorporated into a circuit in electric devices, such as a mobile phone and a personal computer.

To divide a CSP substrate of this type, it is generally known to use a dicing machine for semiconductor wafers that enables cutting so precise that an error even in the order of some microns is not allowed. The dicing machine includes one chuck table and one cutting blade, and cuts a semiconductor wafer placed on the chuck table as follows. That is, cutting lines in the lengthwise direction and the crosswise direction that define semiconductor chips formed on the surface of the semiconductor wafer are detected to position the cutting blade by an alignment. The lengthwise and crosswise cutting positions along these streets are indexed precisely and stored, and on the basis of the cutting positions thus stored, for example, the cutting in the lengthwise direction is performed, after which the chuck table is rotated by 90° to perform the cutting in the crosswise direction next (see JP-A-2001-77057).

When a CSP substrate of this kind is divided, it does not have to be cut at a high degree of precision. However, the cutting is performed deliberately with an extremely high degree of precision as with the cutting of a semiconductor wafer that requires exact precision. This raises a problem that cutting efficiency is poor.

Such being the case, an object of the present invention is to solve the problems discussed above by providing a cutting machine capable of cutting a workpiece appropriately with a degree of precision as required at satisfactory efficiency when dividing a workpiece in the related art, that is, a plate-shaped material, such as a CSP substrate, that is not necessarily cut and divided exactly at a high degree of precision.

SUMMARY OF THE INVENTION

A cutting machine according to the present invention includes a first chuck table that moves in an X-axis direction along a first guide rail, and a second chuck table that moves in the X-axis direction along a second guide rail, provided in parallel with said first guide rail while keeping a predetermined interval, so as not to interfere with said first chuck table, said first chuck table and said second chuck table being allowed to index-rotate while holding plate-shaped materials each to be cut in a first direction and in a second direction; and a first cutting unit including a first rotating axis about which a first cutting blade rotated, and a second cutting unit including a second rotating axis about which a second cutting blade rotates, both to cut said plate-shaped materials held by said first and second chuck tables, wherein said first rotating axis is positioned in a Y-axis direction that intersects with the X-axis direction at right angles, and said first cutting unit is configured to be able to index-move along a third guide rail provided in the Y-axis direction, so that said first cutting unit cuts said plate-shaped material held on said first chuck table in one of the first direction and the second direction as said first chuck table moves in the X-axis direction, and cuts said plate-shaped material held on said second chuck table in one of the first direction and the second direction as the second chuck table moves in the X-axis direction by crossing over said first guide rail; and said second rotating axis is positioned in the Y-axis direction that intersects with the X-axis direction at right angles, and said second cutting unit is configured to be able to index-move along a fourth guide rail provided in the Y-axis direction, so that said first chuck table, which has been rotated by 90°, is positioned at a cutting position of said second cutting unit, and said second cutting unit cuts cutting portions that have not been cut by said first cutting unit in association with movements of said first chuck table in the X-axis direction, and that said second chuck table, which has been rotated by 90°, is positioned at the cutting position of said second cutting unit, and said second cutting unit cuts a cutting portions that have not been cut by said first cutting unit on said plate-shaped material held on said second chuck table in association with movements of said second chuck table in the X-axis direction.

The first cutting unit may be provided with an alignment unit furnished with a function of detecting a portion to be cut on said plate-shaped material, and the portion to be cut on said plate-shaped material held on said first chuck table and the portion to be cut on said plate-shaped material held on said second chuck table are detected by said alignment unit.

Also, it is configured in such a manner that: when a time needed to cut the cutting portion in the first direction and a time needed to cut the cutting portion in the second direction on said plate-shaped material are different, said first cutting unit cuts the cutting portion that needs a shorter cutting time; when a time needed to cut the cutting portion in the first direction and a time need to cut the cutting portion in the second direction on said plate-shaped material are different, said second cutting unit cuts the cutting portion that needs a longer cutting time; and said alignment unit detects a cutting portion on a plate-shaped material to be cut next while said second cutting unit is cutting said plate-shaped material.

Further, the cutting machine of the invention is suitable in a case where the plate-shaped material is a CSP substrate of a rectangular shape provided with plural semiconductor chips formed thereon in a matrix fashion and covered with resin.

According to the cutting machine of the invention, in order to cut and divide a plate-shaped material by cutting in the first direction and the second direction, not only the first and second chuck tables are provided, but also the first and second cutting units are provided. Then, plate-shaped materials are placed on the respective chuck table, and each plate-shaped material is aligned immediately before it is cut, so that the Y-axis index control and the X-axis cutting movement control are established for the culling by the first and second cutting units. A cutting portion in the first direction on the plate-shaped material is cut by the first cutting unit according to the Y-axis index control and the X-axis cutting movement control, and subsequently a cutting portion in the second direction is cut by the second culling unit. Because the culling portions in different directions on the plate-shaped materials placed on the first and second chuck tables are cut by the first and second cutting units by sharing a role, it is possible to cut and divide the plate-shaped material efficiently and appropriately into plural individual semiconductor chips formed thereon in a matrix fashion. In short, it is possible to divide a CSP substrate into individual semiconductor chips with a less degree of precision but at suitable efficiency.

DETAILED DESCRIPTION OF PREFERRED EMBODIMENT

Figure 1:
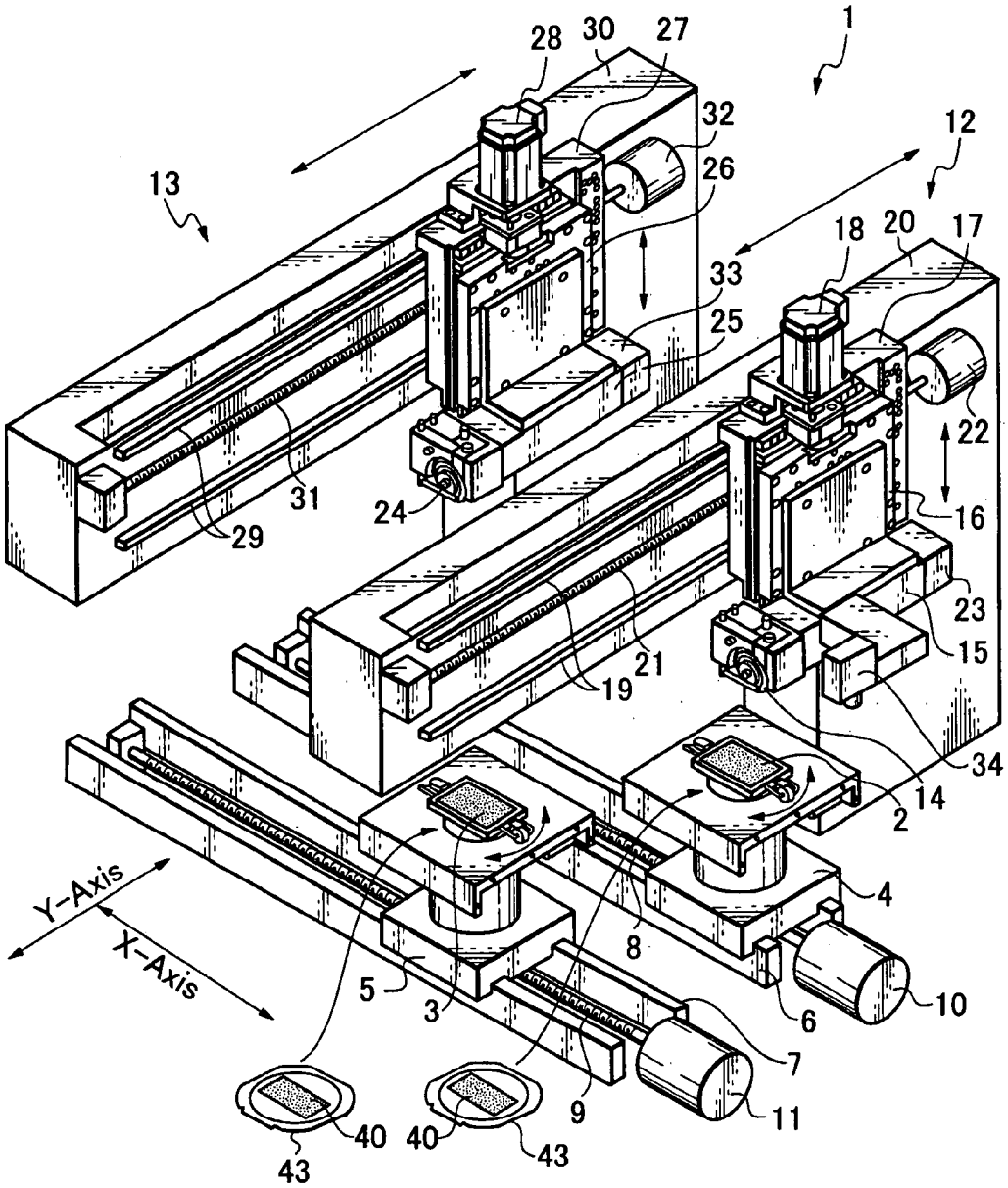
FIG. 1 is a perspective view schematically showing a major portion of a cutting machine according to an embodiment of the invention.

A cutting machine of the invention to divide a plate-shaped material, such as a CSP substrate, will now be described with reference to the drawings. FIG. 1 schematically shows a major portion of a cutting machine 1. The cutting machine 1 includes a first chuck table 2 and a second chuck table 3 to rotate while holding workpieces placed thereon, that is, to rotate by indexing the direction of work. The chuck tables 2 and 3 are attached, respectively, to a first guide rail 6 and a second guide rail 7 via base materials 4 and 5 movably in the X-axis direction. The first and second guide rails are provided in parallel with each other on the same plane while keeping an interval needed to prevent the attached chuck tables 2 and 3 from interfering with each other.

Screw rods 8 and 9 provided respectively in the first and second guide rails are brought into engagement respectively with base materials 4 and 5, so that the chuck tables 2 and 3 move independently in the X-axis direction via the base materials 4 and 5 by driving stepping motors 10 and 11 provided to link with the ends of the respective screw rods.

The cutting machine 1 is also provided with a first cutting unit 12 and a second cutting unit 13 to cut workpiece placed and held on the chuck tables 2 and 3. The first cutting unit 12 includes a spindle unit 15 having inside a first rotating axis defined by a rotating axle to the tip end of which is attached a first cutting blade 14. The spindle unit 15 is attached to a slide plate 16 that moves vertically. The slide plate 16 is attached to a sliding member 17 that is allowed to move in the Y-axis direction. The slide plate 16 moves vertically by means of a stepping motor 18 provided at the top of the sliding member 17, and is thus able to adjust the position in height of the first cutting blade 14 precisely.

The sliding member 17 is attached movably to a third guide rail 19 provided horizontally in a direction intersecting with the first guide rail 6 and the second guide rail 7 at right angles, that is, in the Y-axis direction. The third guide rail 19 is attached to an arm member 20 that stands upright from the main body of the cutting machine 1 and extends horizontally in the Y-axis direction to cross above the first guide rail 6 and the second guide rail 7. The sliding member 17 is configured to engage with a screw rod 21 provided in the third guide rail 19, so that it is able to move by sliding in the Y-axis direction precisely by means of a driving stepping motor 22 provided at one end of the screw rod 21.

When the sliding member 17 is attached in this manner, the spindle unit 15 having inside thereof the first rotating axle attached to the slide plate 16 of the sliding member 17 is positioned in parallel with the third guide rail 19 and the arm member 20, and is thereby positioned in the Y-axis direction. The first rotating axle provided inside the spindle unit 15 is thus driven to rotate by a driving member 23 comprising a motor or the like provided at the rear end.

As same as the first cutting unit 12, the second cutting unit 13 includes a spindle unit 25 having inside a second rotating axis defined by a second rotating axle to the tip end of which is attached a second cutting blade 24. The spindle unit 25 is attached to a slide plate 26 that moves vertically. The slide plate 26 is attached to a sliding member 27 that is allowed to move in the Y-axis direction. The slide plate 26 moves vertically by means of a stepping motor 28 provided at the top of the sliding member 27, and is thus able to adjust the position in height of the second cutting blade 24 precisely.

The sliding member 27 is movably attached to a fourth guide rail 29 provided horizontally in a direction intersecting with the first guide rail 6 and the second guide rail 7 at right angles, that is, in the Y-axis direction. The fourth guide rail 29 is attached to an arm member 30 that stands upright from the main body of the cutting machine 1 and extends horizontally in the Y-axis direction to cross above the first guide rail 6 and the second guide rail 7. The sliding member 27 is configured to engage with a screw rod 31 provided in the fourth guide rail 29, so that it is able to move by sliding in the Y-axis direction precisely by means of a driving stepping motor 32 provided at one end of the screw rod 31.

When the sliding member 27 is attached in this manner, the spindle unit 25 having inside thereof the second rotating axle attached to the slide plate 26 of the sliding member 27 is positioned in parallel with the fourth guide rail 29 and the arm member 30, and is thereby positioned in the Y-axis direction in parallel with the first cutting unit 12 while keeping a necessary interval. The second rotating axle provided inside the spindle unit 25 is thus driven to rotate by a driving member 33 comprising a motor or the like provided at the rear end.

In addition, an alignment unit 34 is provided in the vicinity of the first cutting blade 14 in the first cutting unit 12. Cutting portions on workpiece placed and held on the first and second chuck tables 2 and 3 are detected by the alignment unit 34 for each workpiece and then stored. Cutting work is performed on the basis of indexes thus detected and stored.

The stepping motors 10, 11, 18, 22, 28, and 32 and the driving members 23 and 33 comprising motors or the like as well as other driving sources are connected to a computer (not shown) comprising a controller, a memory, an information input device, etc. provided in the cutting machine 1, and are driven under the control of the controller. The controller drives the cutting machine 1 under control by inputting information, storing information into and reading information from the memory, comparing and judging the contents stored in the memory, etc.

Figure 2:
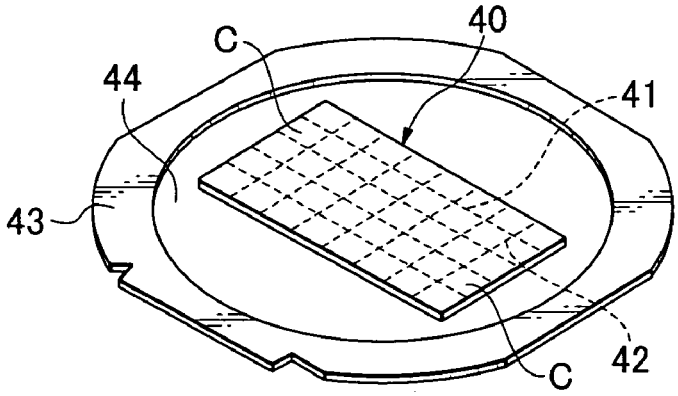
FIG. 2 is a perspective view showing a state when a workpiece to be cut and divided by the cutting machine is attached to a frame.

A workpiece subjected to cutting work is, for example, a plate-shaped material 40 such as a CSP substrate. As is shown in FIG. 2, it is of an oblong shape as a whole provided with plural semiconductor chips C formed thereon in a matrix fashion and covered with resin. It includes lengthwise and crosswise cutting portions, that is, cutting lines 41 in a first direction and cutting line 42 in a second direction, and these cutting portions can be identified. The plate-shaped material 40 having such cutting portions is supported by a specific frame 43 by being bonded nearly at the center with an adhesive tape 44.

Cutting operations of the cutting machine 1 of the invention will now be described. The plate-shaped materials 40, which are workpieces such as CSP substrates, are placed and held on the first and second chuck tables 2 and 3 by setting their directions temporarily while being supported by the frame 43. Prior to the cutting step, the first cutting unit 12 is driven first with respect to the plate-shaped material 40 held on the first chuck table 2. The alignment unit 34 is then placed directly above the plate-shaped material 40 to detect a gap in angle of the plate-shaped material 40 with respect to the X-axis direction and the Y-axis direction, that is, a gap in the cutting work direction as well as the cutting lines 41 and 42 respectively in the first direction and the second direction. A gap in angle can be corrected immediately by index-rotating the first chuck table 2.

Figure 3:
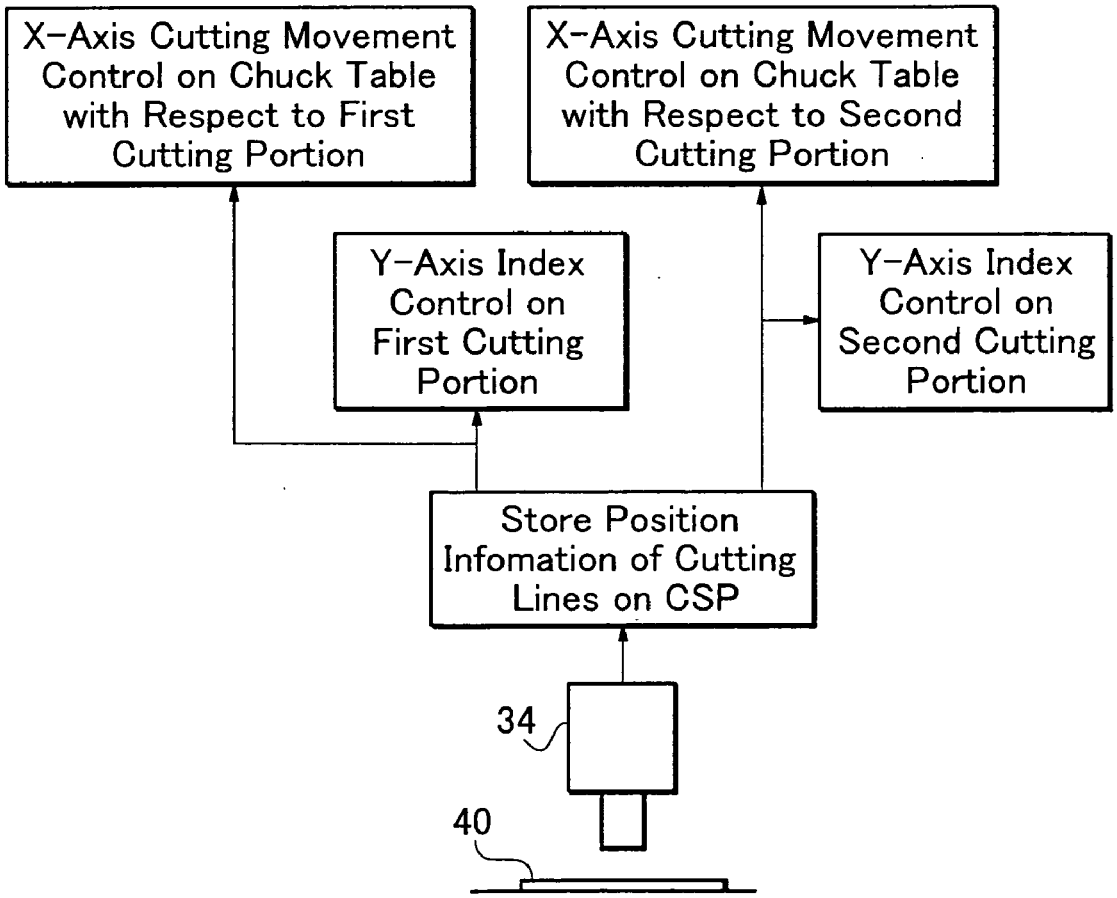
FIG. 3 is a block diagram used to describe cutting operations (index control and cutting movement control) of the cutting machine.

As is shown in FIG. 3, the cutting portions are detected by detecting position information of the cutting lines 41 and 42 respectively in the first direction and the second direction on the plate-shaped material 40 by means of the alignment unit 34, and the position information is inputted into the memory. Then, for the cutting by the first cutting unit 12, a cutting pitch in the Y-axis direction to be cut by the first cutting unit 12, that is, the Y-axis index control is established, while a cutting (moving) stroke of the first chuck table 2 in the X-axis direction with respect to the first cutting unit 12, that is, the X-axis cutting movement control with respect to the first chuck table 2 is established.

At the same time, for the cutting by the second cutting unit 13, a cutting pitch in the Y-axis direction to be cut by the second cutting unit 13, that is, the Y-axis index control is established, while a cutting (moving) stroke of the first chuck table 2 in the X-axis direction with respect to the second cutting unit 13, that is, the X-axis cutting movement control with respect to the first chuck table 2 is established on the basis of the detected position information. In this case, an operation of the first chuck table 2 to rotate by 90° when it has moved to a cutting position of the second cutting unit 13 has been inputted previously into the memory.

After the alignment step is completed as has been described, the first cutting unit 12 operates on the plate-shaped material 40 placed and held on the first chuck table 2. The first cutting blade 14 is then positioned at one of the cutting lines 41 in the first direction by the Y-axis index control on the basis of the position information in the memory, and the first chuck table 2 moves according to the X-axis cutting movement control to cut this particular cutting line 41 in the first direction. Subsequently, the first cutting blade 14 moves per pitch of the cutting lines 41 in the first direction by the Y-axis index control, and the first chuck table 2 moves by a cutting stroke according to the X-axis cutting movement control in association with each movement of the first cutting blade 14. The cutting of the cutting lines 41 in the first direction as intended is thus achieved.

Then, the first chuck table 2 moves toward the second cutting unit 13 and rotates by 90°. The second cutting blade 24 is then positioned at one of the cutting lines 42 in the second direction by the Y-axis index control on the basis of the position information in the memory in the same manner as above. The first chuck table 2 then moves according to the X-axis cutting movement control, and cuts this particular cutting line 42 in the second direction. Subsequently, the second cutting blade 24 moves per pitch of the second cutting lines 42 in the second direction by the Y-axis index control, and the first chuck table 2 moves by a cutting stroke according to the X-axis cutting movement control in association with each movement of the second cutting blade 24. The cutting of the cutting lines 42 in the second direction as intended is thus achieved.

While the second cutting unit 13 is cutting the cutting lines 42 in the second direction, the first cutting unit 12 moves directly above the plate-shaped material 40 placed and held on the second chuck table 3. Then, the plate-shaped material 40 is aligned by the alignment unit 34, and as same as the manner described above, the positions of the cutting lines 41 and 42 respectively in the first direction and the second direction are detected, and position information is inputted into the memory, so that the Y-axis index control to enable the cutting by the first and second cutting units 12 and 13 and the X-axis cutting movement control with respect to the second chuck table 3 are established. In this case, too, an operation of the second chuck table 3 to rotate by 90° when it has moved to a cutting position of the second cutting unit 13 has been inputted previously into the memory. As same as the manner described above, the cutting of the cutting lines 41 in the first direction is performed for the plate-shaped material 40 placed and held on the second chuck table 3 according to the Y-axis index control and the X-axis cutting movement control established previously, by driving the first cutting unit 12.

When the cutting of the cutting lines 42 in the second direction by the second cutting unit 13 is completed, the first chuck table 2 immediately returns to a position at which the initial plate-shaped material 40 is placed for the cut plate-shaped material 40 to be picked up from the first chuck table 2 at this position and put, for example, into a predetermined carrying case, while a new plate-shaped material 40 is placed on the first chuck table 2. The first cutting unit 12, having cut the cutting lines 41 in the first direction on the plate-shaped material 40 on the second chuck table 3, returns toward the first chuck table 2 on which a new plate-shaped material 40 is placed, and performs the cutting in the same manner after the alignment as described above. Meanwhile, the second cutting unit 13 performs the cutting of the cutting lines 42 in the second direction on the plate-shaped material 40 placed on the second chuck table 3, in which the cutting lines 41 in the first direction have been cut, according to the Y-axis index control and the X-axis cutting movement control in the same manner as has been described.

That is to say, in order to cut and divide the plate-shaped material 40, such as a CSP substrate, having the cutting lines 41 in the first direction and the cutting lines 42 in the second direction, not only the first and second chuck tables 2 and 3 are provided, but also the first and second cutting units 12 and 13 are provided. Then, plate-shaped materials 40 are placed on the respective chuck tables, and each plate-shaped material 40 is aligned immediately before it is cut to establish the Y-axis index control and the X-axis cutting movement control to enable the cutting by the first and second cutting units 12 and 13. The cutting lines 41 in the first direction on the plate-shaped material 40 are cut by the first cutting unit 12 according to the Y-axis index control and the X-axis cutting movement control, and subsequently the cutting lines 42 in the second direction are cut by the second cutting unit 13. Because the cutting portions in different directions on the plate-shaped materials 40 placed on the first and second chuck tables 2 and 3 are cut by the first and second cutting units 12 and 13 by sharing a role, it is possible to cut and divide the plate-shaped material 40 efficiently into individual semiconductor chips C provided in a matrix fashion.

In addition, when the plate-shaped material 40 is cut along the cutting lines 41 in the first direction and the cutting lines 42 in the second direction, it is cut from one direction per cutting pitch through the cutting operations by the cutting units. The cutting units thus reciprocate per cutting pitch, and a slight stand-by time is needed until the cutting operations begin due to pitch feeding that takes place for each cutting. This extends a time needed for the cutting longer for the cutting lines 42 in the second direction than for the cutting lines 41 in the first direction because the cutting lines 42 outnumber the cutting lines 41. Hence, it is preferable in terms of efficiency to assign the cutting of the cutting lines 41 in the first direction that needs a shorter cutting time to the first cutting unit 12 because of the alignment step performed prior to the cutting by the alignment unit 34.

As has been described, because two cutting units share a role, the cutting machine of the invention is able to cut and divide the plate-shaped material efficiently and appropriately into plural individual semiconductor chips formed thereon in a matrix fashion, and therefore can be used widely for the manufacturing of chips for which a dividing error is less strictly managed.

What is claimed is:

1. A cutting machine, comprising:

a first chuck table that moves in an X-axis direction along a first guide rail, and a second chuck table that moves in the X-axis direction along a second guide rail and is provided in parallel with said first guide rail while keeping a predetermined interval so as not to interfere with said first chuck table, said first chuck table and said second chuck table being allowed to index-rotate while holding plate-shaped materials each to be cut in a first direction and in a second direction; and a first cutting unit including a first cutting blade rotatable about a first rotating axis, and a second cutting unit including a second cutting blade rotatable about a second rotating axis, both to cut said plate-shaped materials held by said first and second chuck tables, wherein:

said first rotating axis is positioned in a Y-axis direction that intersects with the X-axis direction at right angles, and said first cutting unit is configured to be able to index-move along a third guide rail provided in the Y-axis direction, so that said first cutting unit cuts said plate-shaped material held on said first chuck table in one of the first direction and the second direction as said first chuck table moves in the X-axis direction, and by crossing over said first guide rail, cuts said plate-shaped material held on said second chuck table in one of the first direction and the second direction as the second chuck table moves in the X-axis direction; and said second rotating axis is positioned in the Y-axis direction that intersects with the X-axis direction at right angles, and said second cutting unit is configured to be able to index-move along a fourth guide rail provided in the Y-axis direction, so that said first chuck table, which has been rotated by 90°, is positioned at a cutting position of said second cutting unit, and in association with movements of said first chuck table in the X-axis direction, said second cutting unit cuts said plate-shaped material held on said first chuck table in the other of the first direction and the second direction, and that said second chuck table, which has been rotated by 90°, is positioned at a cutting position of said second cutting unit, and in association with movements of said second chuck table in the X-axis direction, said second cutting unit cuts said plate-shaped material held on said second chuck table in the other of the first direction and the second direction.

2. A cutting machine according to claim 1, wherein said first cutting unit is provided with an alignment unit furnished with a function of detecting a portion to be cut on said plate-shaped material; and the portion to be cut on said plate-shaped material held on said first chuck table, and the portion to be cut on said plate-shaped material held on said second chuck table are detected by said alignment unit.

3. A cutting machine according to claim 2, wherein:

when a time needed to cut the cutting portion in the first direction and a time needed to cut the cutting portion in the second direction on said plate-shaped material are different, said first cutting unit cuts the cutting portion that needs a shorter cutting time;

when a time needed to cut the cutting portion in the first direction and a time need to cut the cutting portion in the second direction on said plate-shaped material are different, said second cutting unit cuts the cutting portion that needs a longer cutting time; and said alignment unit detects a cutting portion on a plate-shaped material to be cut next while said second cutting unit is cutting said plate-shaped material.

4. The cutting machine according to claim 1, wherein said plate-shaped material is a CSP substrate of a rectangular shape provided with plural semiconductor chips formed thereon in a matrix fashion and covered with resin.

* * * * *